US006314846B1

(12) United States Patent
Winick

(10) Patent No.: US 6,314,846 B1
(45) **Date of Patent: *Nov. 13, 2001**

(54) TORQUE WRENCH

(75) Inventor: Alan Lee Winick, San Jose, CA (US)

(73) Assignee: Sun Microsystems, Inc., Palo Alto, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/421,964

(22) Filed: Oct. 20, 1999

(51) Int. Cl.[7] ..... B25B 23/159
(52) U.S. Cl. ..... 81/477
(58) Field of Search ..... 81/477

(56) References Cited

U.S. PATENT DOCUMENTS 86,845 * 2/1869 Laflin ..... 81/477
3,283,620 * 11/1966 Bailey ..... 81/477
3,485,117 * 12/1969 Tyrrell et al. ..... 81/477

* cited by examiner

*Primary Examiner*—Joseph J. Hail, III
*Assistant Examiner*—David B. Thomas
(74) *Attorney, Agent, or Firm*—Conley, Rose & Tayon, PC; B. Noël Kivlin

(57) ABSTRACT

A torque wrench having an indicator may be used to apply a desired amount of torque to a fastener to secure together two printed circuit boards within an electronic system. The torque wrench includes a handle and a drive head. The handle may include a lever arm, a looped section, and a drive section. A gap is formed between a portion of the lever arm and a portion of the drive section. When force is applied to the handle to tighten a fastener, the force causes the gap to narrow. A desired amount of torque is applied to the fastener by the torque wrench when the gap between the portion of the lever arm and the portion of the drive section closes. The torque wrench is storable within an enclosure of the electronic system when not in use to tighten a fastener.

11 Claims, 5 Drawing Sheets

TORQUE WRENCH

BACKGROUND OF THE INVENTION

1. Field of the Invention

This invention generally relates to torque wrenches, and more particularly, the invention relates to a torque wrench that visually indicates when a desired torque has been applied to a fastener. The torque wrench may be used in electronic systems, and the torque wrench may be storable within an enclosure of the electronic system.

2. Description of the Related Art

Torque wrenches are typically used to apply a selected amount of torque to a threaded fastener to connect two elements together. The fastener may be in the nature of a bolt, screw, or nut. Applying excessive torque to a fastener may result in damage to the threading of the fastener, or excessive torque may damage the elements that the fastener joins together. Applying too little torque to a fastener may result in a loose connection between the two elements.

There are several types of torque wrenches that are capable of applying a desired torque to a fastener. One type of torque wrench informs a user when a specific torque has been applied by producing a loud click. The user of this type of torque wrench hears and feels the click when the user applies a specific amount of torque to a fastener. Another type of torque wrench indicates when a specific torque has been applied by disengaging a driving head when the specific amount of torque has been applied. Another type of torque wrench has a gage that indicates the amount of torque that has been applied to a fastener. Some disadvantages of these types of torque wrenches may include that the torque wrenches are mechanically complicated and expensive. Also, these types of torque wrenches may require regular calibration to ensure that the torque wrenches indicate a desired torque during use.

Many electrical systems have components that are connected by fasteners to a circuit board. In one type of connection, a connecting edge of a card may be inserted into a corresponding high density connector socket on a circuit board. The connecting edge may be a single continuous edge, or the connecting edge may have a high density of conducting members or conductors. The connecting edge may necessitate careful tightening of fasteners that attach the card to a socket on the circuit board. If the fasteners are not tightened enough, all of the connecting edge may not make contact with corresponding connections in the socket. If the fasteners are tightened too tightly, the connecting edge or the socket connections may be damaged.

SUMMARY OF THE INVENTION

The problems outlined above may in large part be solved by a torque wrench which has a visible indicator that informs a user when a desired amount of torque has been applied to a fastener. The torque wrench may be used to tighten a fastener with a proper amount of torque, or the torque wrench may be used to test if a tightened fastener has been tightened with a sufficient amount of torque. The torque wrench is mechanically simple, easily producible, inexpensive, and does not require calibration. The torque wrench includes a handle and a drive head. The handle includes a lever arm, a looped section, and a drive section. A gap is formed between an end of the lever arm and a portion of the drive section.

A drive head for the torque wrench may be an integral part of the drive section of the handle. The drive head of the torque wrench may be coupled to a tool opening in the head of a fastener. The tool opening may be adapted to accept any of a variety of different types of drive heads including, but not limited to a screw driver blade, a hex head drive, a square head drive, or a star drive. When the drive head is coupled to a tool opening of a fastener, applying force to the handle may result in torque being transmitted to the fastener.

To tighten a fastener having right-handed threading with the torque wrench, the fastener is placed in a threaded opening and tightened by hand in a clockwise direction. To apply a proper torque to the fastener, the drive head of the torque wrench is placed in the tool opening of the fastener. Force is applied to the lever arm of the torque wrench to rotate the fastener in a clockwise direction. The application of force to the lever arm causes the gap between ends of the looped section to narrow. The proper amount of torque is applied to the fastener when the gap between the end of the lever arm and the portion of the drive section closes. The user can watch the gap as force is applied to the lever arm, and the user can stop applying force when the gap closes.

A common problem associated with using a torque wrench to apply a selected amount of torque to a fastener is that the torque wrench is not immediately at hand when the user desires to install a card within a system. This problem may be overcome by having a receptacle within a electronic system for storing the torque wrench. The receptacle may be a drawer which is positionable in a device bay of a computer enclosure. When a user needs to install a card on a circuit board, the user can open the drawer, remove the torque wrench, and use the torque wrench to install the card with the proper amount of torque. After use, the user can return the torque wrench to the storage compartment. Because the torque wrench is easily producible and inexpensive, a drawer and torque wrench may be installed in a new computer system during assembly of the system.

Figure 2:
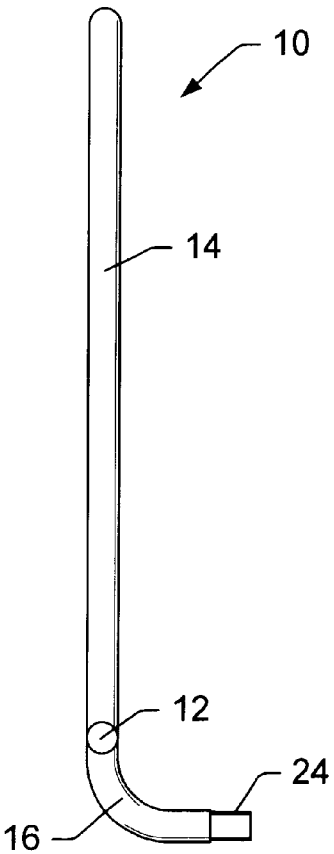
FIG. 2 is a side view of the embodiment of a torque wrench shown in FIG. 1.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but to the contrary, the intention is to cover all modifications, equivalents and alternatives falling within the spirit and scope of the present invention as defined by the claims.

DETAILED DESCRIPTION OF THE PREFERRED EMBODIMENTS

Figure 1:
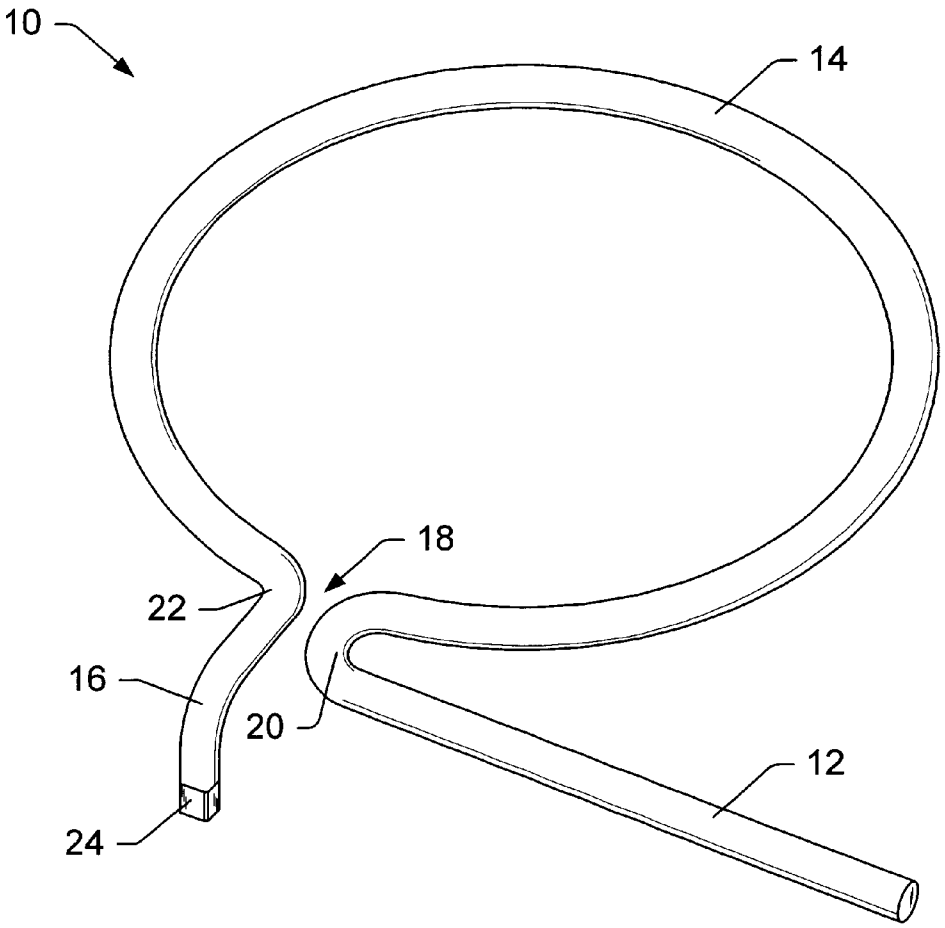
FIG. 1 is a perspective view of an embodiment of a torque wrench.

With reference to the drawings, and more particularly to FIGS. 1 and 2, a torque wrench is designated as 10. The torque wrench may include lever arm 12, arcuate or loop section 14, and drive section 16. Gap 18 is formed between end 20 of the lever arm 12 and a portion 22 of the drive section of the drive section 16. The drive section 16 may include drive head 24 at an end of the drive section. The drive head 24 may be positioned approximately perpendicular to the longitudinal axis of the lever arm 12. The torque wrench 10 may be made of 3.5-millimeter diameter, steel music wire.

Figure 3:
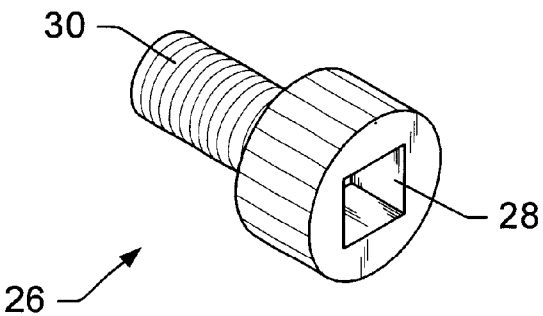
FIG. 3 is a perspective view of a fastener.

FIG. 3 shows a perspective view of fastener 26. The fastener 26 shown in FIG. 3 has tool opening 28, and threaded portion 30. The tool opening 28 has a shape that generally corresponds to the shape of the drive head 24 of the torque wrench 10. The tool opening 28 may be adapted to accept any one of a variety of different types of drive heads including, but not limited to, a screw driver blade, a hex head drive, a square head drive, or a star drive. Applying force to the lever arm 12 to tighten a fastener 26 results in torque being transmitted to the fastener when the drive head 24 is coupled to a tool opening 28 of the fastener.

Figure 4:
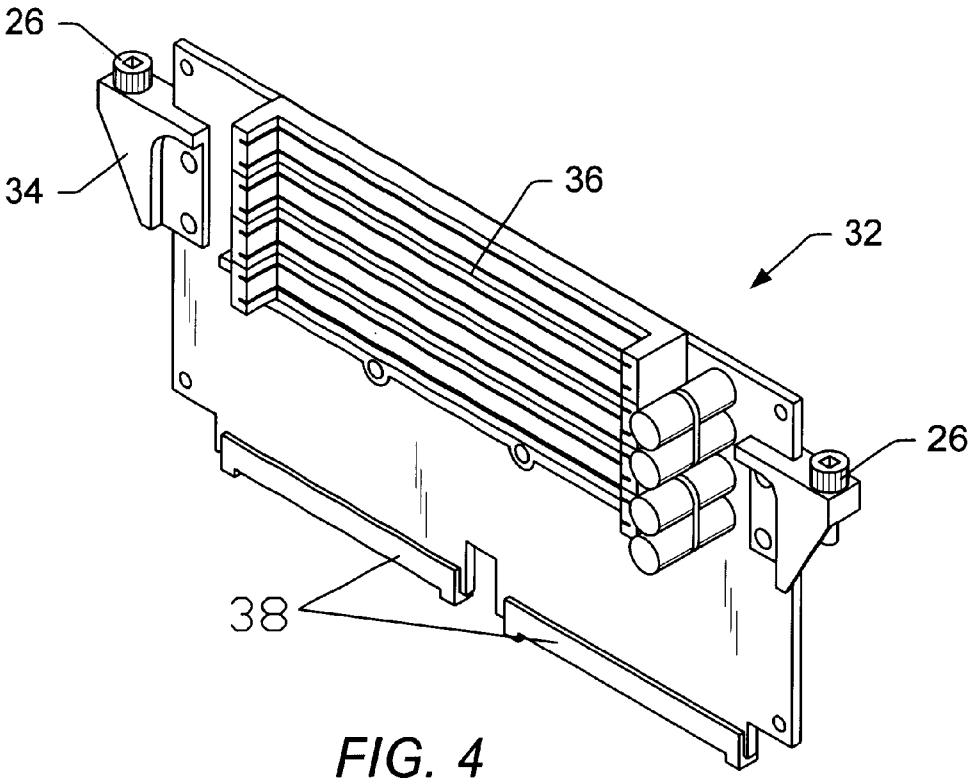
FIG. 4 depicts a card having a pair of fasteners.
Figure 5:
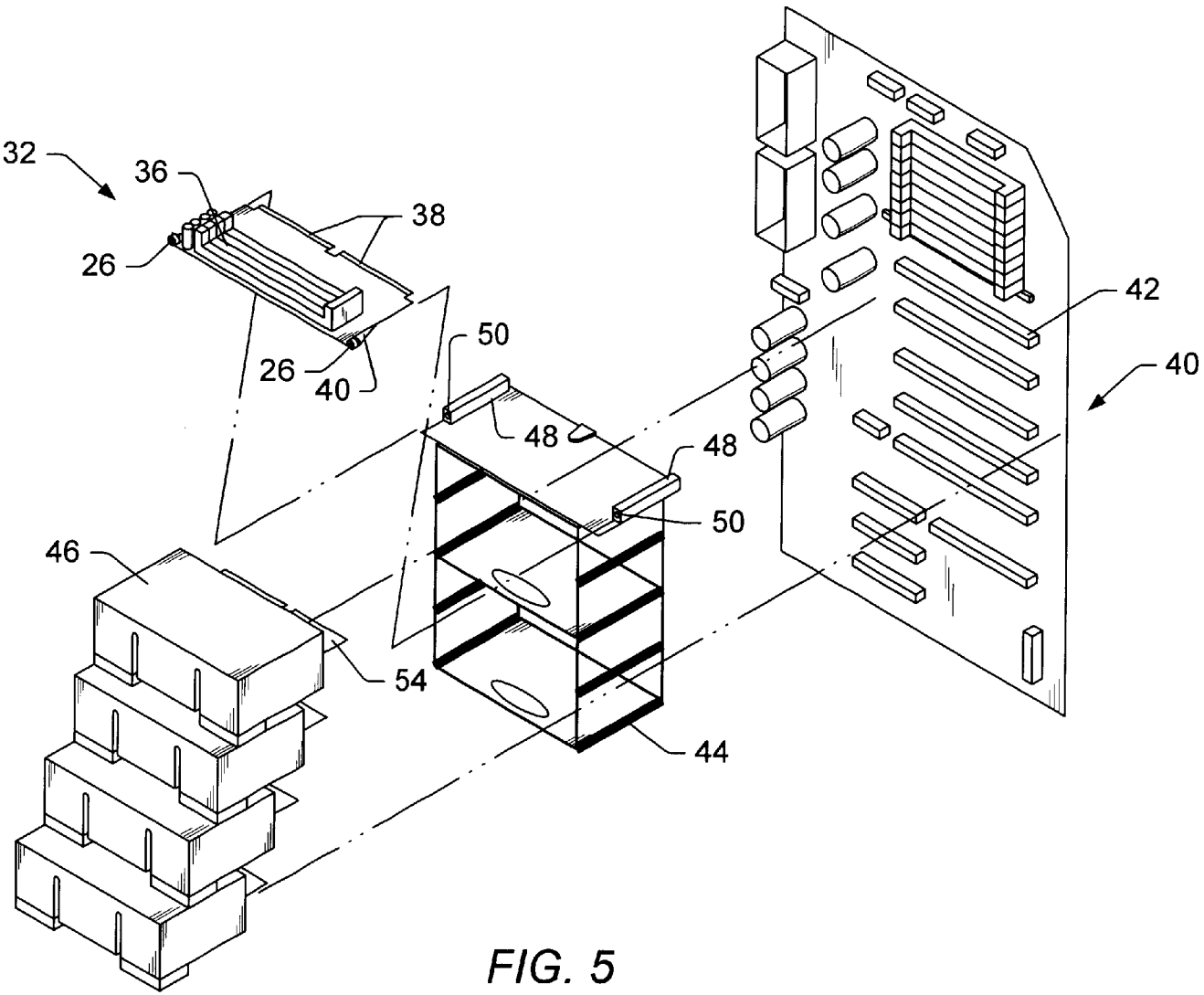
FIG. 5 is an illustration of the position of a riser card on a circuit board.

FIG. 4 illustrates riser card 32. The riser card 32 may include fasteners 26, brackets 34, slots 36, and connector 38. FIG. 5 is an illustration of the position of riser card 32 on circuit board 40. The circuit board 40 may include a number of sockets 42. The sockets 42 may allow for the attachment of various printed circuit boards (PCB's) to the circuit board 40. The riser card 32 may be one such PCB.

As shown in the illustration of FIG. 5, the riser card 32 may be supported by central processing unit (CPU) shroud 44. The CPU shroud 44 may allow a number of CPU logic cards 46 to be easily inserted onto, or easily removed from, the circuit board 40. The shroud 44 may include two channels 48 which have threaded portions 50 configured to mate to the threaded portions 30 of the fasteners 26.

The connector 38 of the riser card 32 may be inserted into a socket 42 on a circuit board 40 to electrically connect the card to the circuit board. The connector 38 may have a single continuous edge, or the connector may have a high density of conducting members or conductors. The connector 38 may necessitate careful tightening of fasteners 26 that attach the card 32 to a socket 42 on the circuit board 40. If the fasteners 26 are not tightened enough, there may not be a good connection between the connector 38 and the socket 42. If the fasteners 26 are tightened too tightly, the connector 38 or the socket 42 may be damaged.

The CPU shroud 44 may be mounted on the circuit board 40. To insert riser card 32 onto the circuit board 40, the riser card may be placed on the top of the channels 48 of the CPU shroud 44. The connector 38 of the card 32 may be inserted into a socket 42. The threaded portions 30 of the fasteners 26 may be inserted into the threaded portions 50 of the channels 48. The fasteners 26 may then be hand tightened to connect the fastener to the shroud 44. After the fasteners 26 are hand tightened, the drive head 24 of the torque wrench 10 may be inserted into a tool opening 28 of a fastener. The user grips the lever arm 12 and applies force to the lever arm to tighten the fastener 26. Applying force to the lever arm to tighten the fastener causes the gap 18 between the end 20 of the lever arm and the portion 22 of the drive section 16 to narrow. A proper amount of torque is applied to a fastener 26 when the gap 18 closes. When the gap 18 closes, the user quits applying force to the lever arm 12. The torque wrench 10 may then be used to tighten the other fastener 26. For many cards 32, the proper amount of torque that should be applied to fasten the card to a circuit board 40 is approximately 3.5 inch-pounds.

Figure 6:
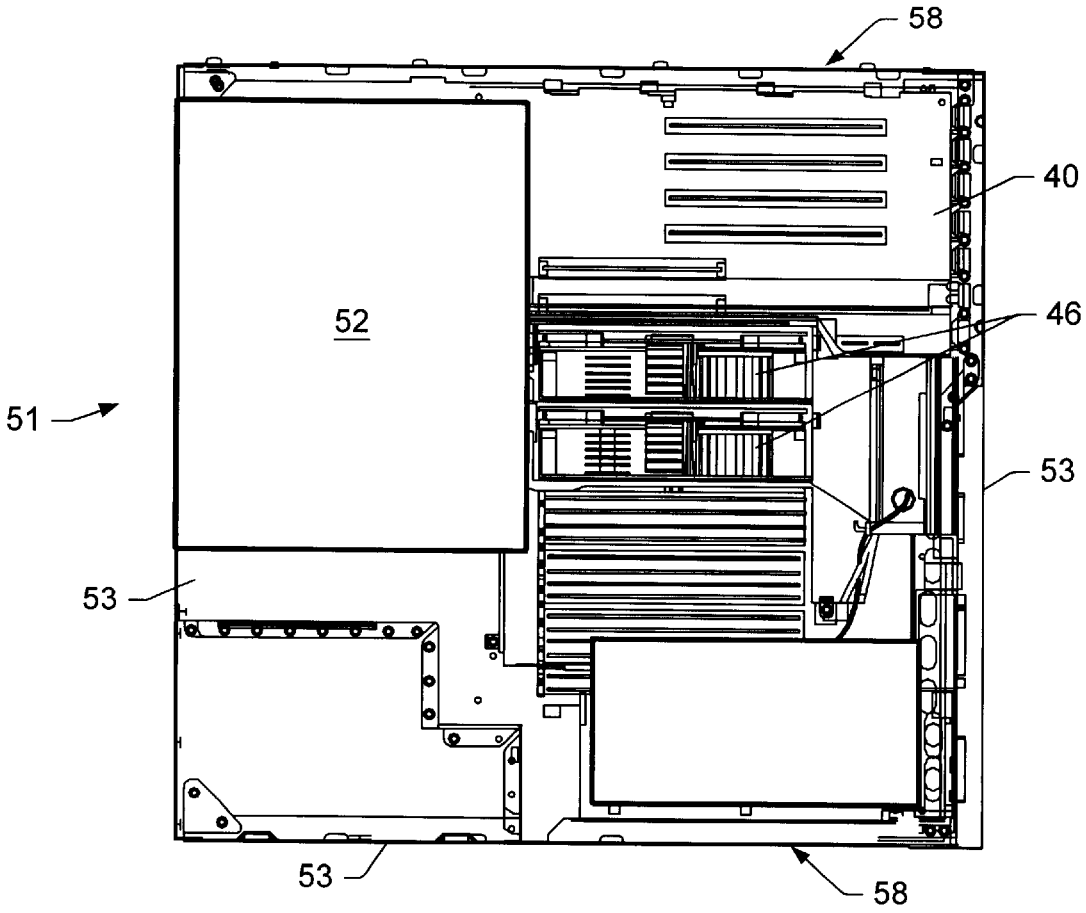
FIG. 6 is a side elevational view of a computer system without a side panel.
Figure 7:
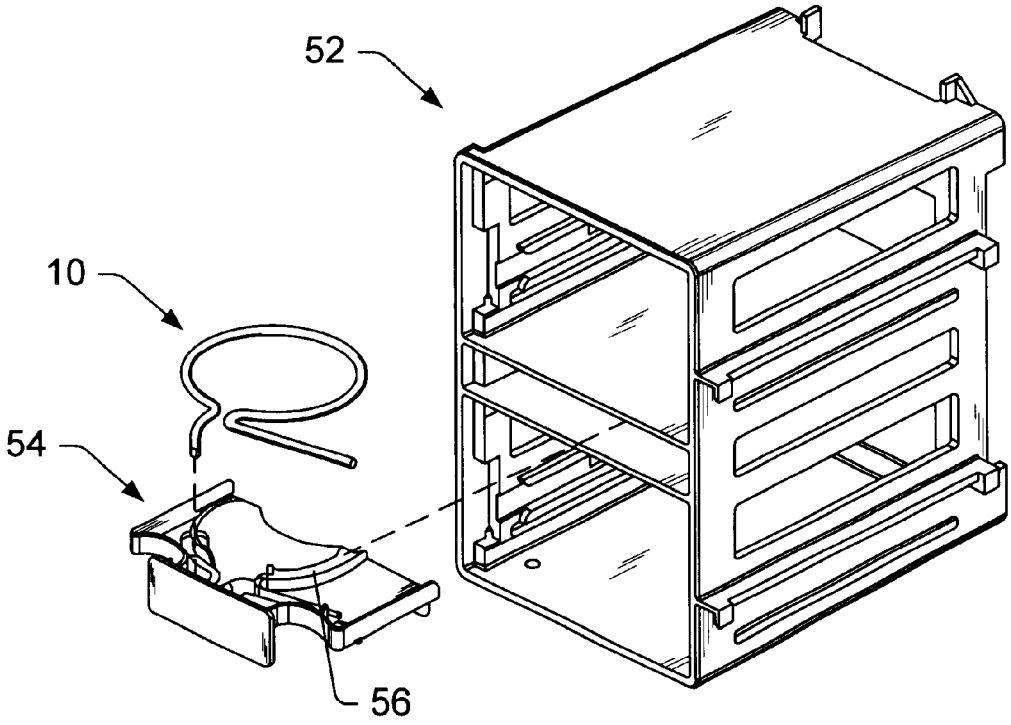
FIG. 7 is a perspective view of a device bay with a wrench drawer.

FIG. 6 is a schematic illustration of a partially assembled computer system 51 without a side panel. The computer system 51 may include drive bay 52, circuit board 40, and CPU modules 46. The drive bay 52 may be a housing for mounting disk drives (not shown) or other types of drives within a computer system. FIG. 7 shows a perspective view of a drive bay 52. The drive bay 52 may include drawer 54. The drawer 54 may be shaped to hold a torque wrench 10. The drawer 54 may have guides 56 that are configured to secure a torque wrench 10 to the drawer.

When a user needs to add a card 32 to a circuit board 40 within a computer system, the user can open the drawer 54 and remove the torque wrench 10. The torque wrench 10 can be used to apply the proper amount of torque to a fastener 26 to secure the card 32 to a circuit board 40. After use, the torque wrench 10 may be replaced in the drawer 54 so that the torque wrench will be on hand if another card is added to the computer system 51 at a later time. In an alternate embodiment, the torque wrench may be attached to guides which secure the torque wrench to the side of the drive bay or to a panel 53 of a system enclosure 58 in a location where the torque wrench does not interfere with any other components mounted within the system.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

What is claimed is:

1. A computer system comprising:

an enclosure;

a printed circuit board positioned within the enclosure and having a socket mounted thereon;

a riser card;

a threaded fastener which secures the riser card in electrical engagement with the socket, wherein the threaded fastener includes a head;

a receptacle within the enclosure; and a torque wrench inserted within the receptacle, wherein the torque wrench includes:

an arm;

a drive section attached to the arm;

a gap between a portion of the arm and a portion of the drive section; and a drive head at an end of the drive section, the drive head being shaped to engage the head of the threaded fastener.

2. The computer system as defined in claim 1, further comprising an arcuate section between the end of the arm and an end of the drive section of the torque wrench.

3. The computer system as defined in claim 1, wherein the drive head is configured to engage with a fastener having a square-head tool opening.

4. The computer system as defined in claim 1, wherein the torque wrench is made of steel wire.

5. The computer system as defined in claim 1, wherein the gap closes when approximately 3.5 inch-pounds of torque is applied to the fastener by the torque wrench.

6. The computer system as defined in claim 1, further comprising a housing within the enclosure configured to hold components, and wherein the receptacle is positionable within the housing.

7. A computer system comprising:

an enclosure;

a printed circuit board positioned within the enclosure and having a socket mounted thereon;

a riser card;

a threaded fastener which secures the riser card in electrical engagement with the socket, wherein the threaded fastener includes a head;

a drive bay within the enclosure;

a drawer slidable within the drive bay, wherein the drawer is configured to be opened when a portion of the enclosure is removed; and a torque wrench, the torque wrench configured to reside in the drawer when not in use with a fastener, and wherein the torque wrench includes:

an arm;

a drive section attached to the arm;

a gap between a portion of the arm and a portion of the drive section; and a drive head at an end of the drive section, the drive head being shaped to engage the head of the threaded fastener.

8. The computer system as defined in claim 7, further comprising an arcuate section between the end of the arm and an end of the drive section of the torque wrench.

9. The computer system as defined in claim 7, wherein the drive head is configured to engage with a fastener having a square-head tool opening.

10. The computer system as defined in claim 7, wherein the torque wrench is made of steel wire.

11. The computer system as defined in claim 7, wherein the gap closes when approximately 3.5 inch-pounds of torque is applied to the fastener by the torque wrench.

* * * * *

UNITED STATES PATENT AND TRADEMARK OFFICE

CERTIFICATE OF CORRECTION

PATENT NO. : 6,314,846 B1
DATED : November 13, 2001
INVENTOR(S) : Alan Lee Winick It is certified that error appears in the above-identified patent and that said Letters Patent is hereby corrected as shown below:

Title page,
Item [54], please change the title to: -- TORQUE WRENCH FOR A COMPUTER SYSTEM --

Signed and Sealed this

Thirteenth Day of August, 2002

*Attest:*

*Attesting Officer*

JAMES E. ROGAN
*Director of the United States Patent and Trademark Office*